343-754 SR
1/22/80 OR 4,185,286

United States Patent [19] [11] 4,185,286
Drabowitch et al. [45] Jan. 22, 1980

[54] NONDISPERSIVE ARRAY ANTENNA

[75] Inventors: Serge Drabowitch; Bernard Daveau, both of Paris, France

[73] Assignee: Thomson-CSF, Paris, France

[21] Appl. No.: 884,802

[22] Filed: Mar. 9, 1978

[30] Foreign Application Priority Data

Mar. 11, 1977 [FR] France ..... 7707331

[51] Int. Cl.[2] ..... H01Q 15/02
[52] U.S. Cl. ..... 343/754; 343/771; 343/895
[58] Field of Search ..... 343/754, 854, 895, 770, 343/771, 853, 909

[56] References Cited

U.S. PATENT DOCUMENTS

| | | | |
|---|---|---|---|
| 3,631,503 | 12/1971 | Tang et al. | 343/854 |
| 3,931,624 | 1/1976 | Hundley et al. | 343/771 |
| 3,971,022 | 7/1976 | Lenz | 343/754 |
| 3,978,484 | 8/1976 | Collier | 343/754 |
| 4,044,360 | 8/1977 | Wolfson et al. | 343/754 |

*Primary Examiner*—Eli Lieberman
*Attorney, Agent, or Firm*—Karl F. Ross

[57] ABSTRACT

A nondispersive array antenna comprises a linear primary radiator array in the form of a slotted waveguide emitting high-frequency waves toward a linear secondary radiator array including an acute angle $\alpha$ with the primary array, this angle $\alpha$ being approximately equal to $(\pi/4) - (\theta_o/2)$ where $\theta_o$ is the angle included by the emitted beam with the perpendicular to the waveguide in the plane of radiation. The secondary array includes a row of elemental radiation receivers on the side facing the primary array and as many elemental radiation emitters on the opposite side; each radiation receiver is linked to a respective radiation emitter through a coupling introducing a predetermined phase shift between incoming and outgoing radiation, these phase shifts compensating for the phase displacement occurring along the arrays in the free-space propagation of the waves from one array to the other. The elemental radiation emitters may be helices with axes perpendicular to the secondary array, the introduced phase shift being determined by the angular orientation of each helix. A multiplicity of primary and secondary arrays may be superposed to form radiating panels for the emission of a beam of two-dimensional cross-section whose angular orientation relative to the plane containing the angle $\alpha$ can be varied by adjusting the relative phasing of waves fed to the waveguides constituting the primary panel.

12 Claims, 4 Drawing Figures

NONDISPERSIVE ARRAY ANTENNA

FIELD OF THE INVENTION

Our present invention relates to an array antenna and in particular to an antenna which is nondispersive and small in size. By "nondispersive array antenna" is meant an antenna in which the direction of maximum radiation is virtually independent of frequency. Our invention also relates to an expansion of such an antenna into an electronically scanning antenna structure.

BACKGROUND OF THE INVENTION

Array antennas are known which have the characteristic of being nondispersive. In this context we may mention the so-called "candlestick" array antenna in which a first-stage supply channel branches into second-stage supply channels which in turn are branched until a final stage is reached where all the supply channels so obtained are connected to radiating elements acting as individual feeds. Such an antenna structure, which contains a number of Magic Tees or dividers, is complex and bulky as well as, in many instances, heavy and expensive.

Another previously proposed structure for nondispersive antennas contains a supply guide working, via directional couplers, into guides supplying the individual feeds, the assembly being such that the electrical lengths of the supply circuits for the individual feeds are all the same.

This antenna structure, although less bulky than the first-mentioned one, is still rather complicated from the point of view of mechanical construction, especially if the number of individual feeds is high (of the order of a hundred).

Other kinds of nondispersive attennas may also be mentioned, in particular active lenses and reflector arrays which are supplied through free space from a single primary feed. However, such antennas have the disadvantage that their longitudinal dimensions are equal to the focal length of the system, which is considerable. Moreover, there is a danger of the primary radiation spilling over the periphery of the array, which may produce undesirable diffuse radiation.

OBJECT OF THE INVENTION

The object of our invention is to provide a nondispersive array-type antenna structure which does not suffer from the disadvantages set forth above and which combines the advantages of supply through guides and through free space.

SUMMARY OF THE INVENTION

Our improved antenna comprises a primary and a secondary radiator array including an acute angle $\alpha$ with each other in a plane of radiation in which high-frequency waves fed by a source to the primary array pass from the latter to the secondary array. The primary array, pursuant to our present invention, is formed from at least one row of elemental radiators, specifically slots of a waveguide with an input end connected to the source, the waves issuing from the slots passing to the secondary array at a frequency-dependent angle $\theta$ to a line perpendicular to the waveguide. The secondary array is formed from a multiplicity of elemental radiation receivers and a like multiplicity of elemental radiation emitters disposed back-to-back in at least one pair of parallel rows, the radiation receivers facing the primary array and being linked with respective radiation emitters proximal thereto by coupling means introducing predetermined phase shifts between incoming and outgoing radiation. These phase shifts are so chosen as to compensate for the phase displacement undergone along the two arrays by the waves passing in the plane of radiation from the elemental radiators of the primary array to the radiation receivers of the secondary array whereby the latter generates an outgoing beam with a wavefront paralleling the row of radiation emitters thereof.

In accordance with another feature of our invention, the radiation emitters of the secondary array are helices with mutually parallel axes. The coupling means linking these helices with the associated radiation receivers, which are advantageously constituted by dipoles, then comprises mountings enabling a rotation of the helices about their axes so that their relative angular positions introduce the desired phase shifts.

With the primary array comprising a slotted waveguide as stated above, the nondispersive character of the antenna is assured by relating the acute angle $\alpha$ to the frequency-dependent angle $\theta_0$, given for a particular reference frequency $f_0$, by the formula $\alpha \approx (\pi/4)-(\theta_0/2)$; as will become apparent hereinafter, that relationship applies when the reference frequency $f_0$ is remote from the cutoff frequency of the waveguide.

BRIEF DESCRIPTION OF THE DRAWING

These and other features of our invention will become apparent from the following description given with reference to the accompanying drawing wherein:

FIG. 3 is a diagrammatic view of another embodiment of our invention; and

SPECIFIC DESCRIPTION

Figure 1:
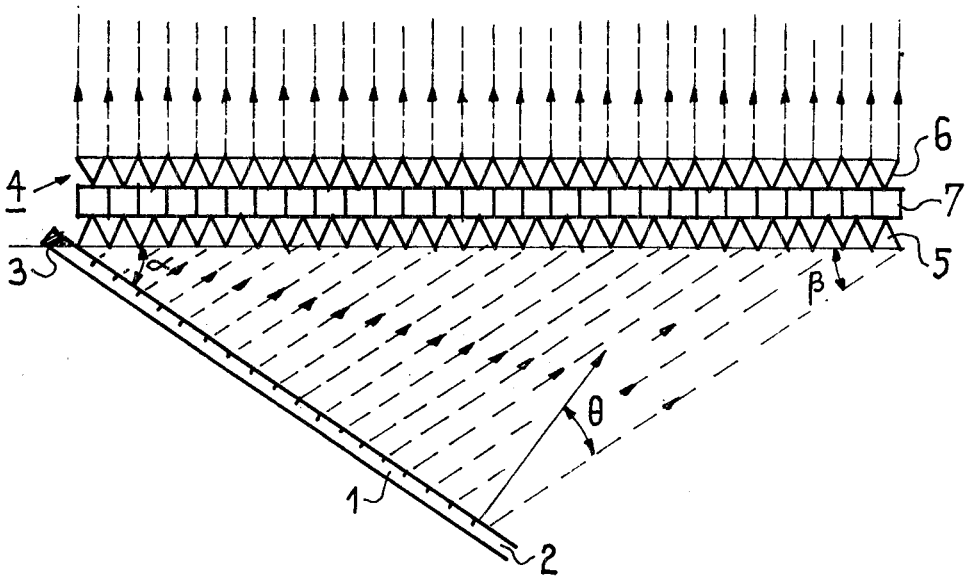
FIG. 1 is a diagrammatic view of one embodiment of an antenna according to our invention.

FIG. 1 shows, in diagrammatic form, an embodiment of an array antenna according to our invention. This antenna comprises a first or primary linear array 1, of dispersive character, which may be a simple slotted guide fed from one end 2, the other end being closed by an absorbent load 3. A secondary linear array 4 is arranged with its major dimension including an acute angle $\alpha$ with the primary array. In the embodiment here considered, this secondary array is double-faced, having an inner face turned toward the primary array 1 and an outer face confronting the space irradiated by the array antenna so constituted. The inner and outer faces are formed by radiating elements 5 and 6 of the horn type. Aligned radiators 5 and 6 on the inner and outer faces are interconnected by respective fixed phase shifters 7. In the case of horns it will be apparent that the polarization of the radiated wave is linear. In cases where the polarization of the radiation is circular, the outer face is advantageously formed by helics or coils (see FIG. 3) whose angular setting produces the requisite fixed phase shift, thus allowing the phase shifters 7 to be dispensed with.

As regards the operation of such a nondispersive array antenna, we have found that, when fed with a traveling wave at its input end 2, the primary array 1 radiates a planar wave whose direction of propagation varies with frequency. This wave impinges on the inner face of the secondary array 4 at an acute angle of incidence and in the fixed phase shifters 7 undergoes a phase shift which varies linearly from the first phase shifter to the last, with the result that the direction of radiation of the wave emitted by the secondary array is perpendicular to the major faces of this array. The phase shift to which the wave feeding the secondary array is subjected thus has the effect of compensating for the phase variation caused by the oblique impingement of the primary radiated wave on the secondary array, and thus of producing a planar wavefront in the output of the secondary array.

In the embodiment of FIG. 1, the primary array 1 is advantageously a slotted guide whose slots are arranged in the large or the small side of the guide depending on whether the polarization of the wave is in the plane of the two arrays or perpendicular to it.

As regards the secondary array 4, it may thus be considered equivalent to a prism whose inherent dispersivity cancels out that of the primary array. From this viewpoint the nondispersive array according to the invention may be termed a prism-array antenna.

The foregoing description shows that in defining a prism-array antenna according to the invention a choice has to be made as to the frequency and phase of the wave feeding the primary array. Nor is the choice of the angle $\alpha$ between the two linear arrays 1 and 4 immaterial. It is dictated by the possibility of finding points, distributed along a straight line including a certain angle with the primary array, where the phase is steady with respect to frequency. If such a straight line or lines exist, an array situated on one of them will be fed with a constant phase and, if the array radiates in a direction which is perpendicular to it, it will be nondispersive. It may be mentioned that under these conditions the phase shifters 7 need to be fixed and to create a linear overall characteristic.

Figure 2:
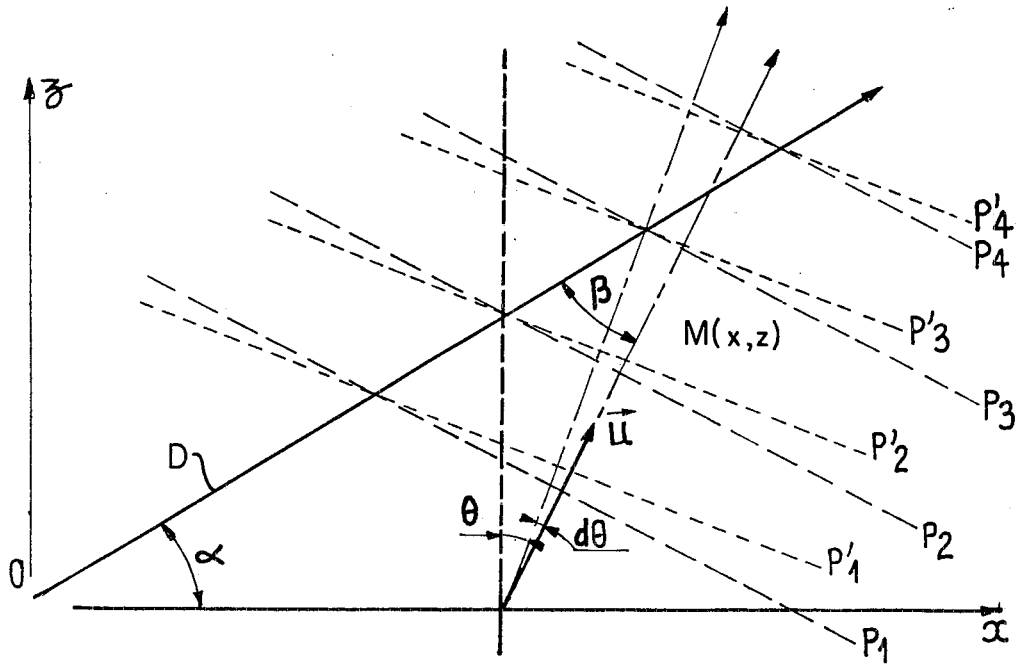
FIG. 2 is a graph serving to explain the theory of the antenna.
Figure 5:
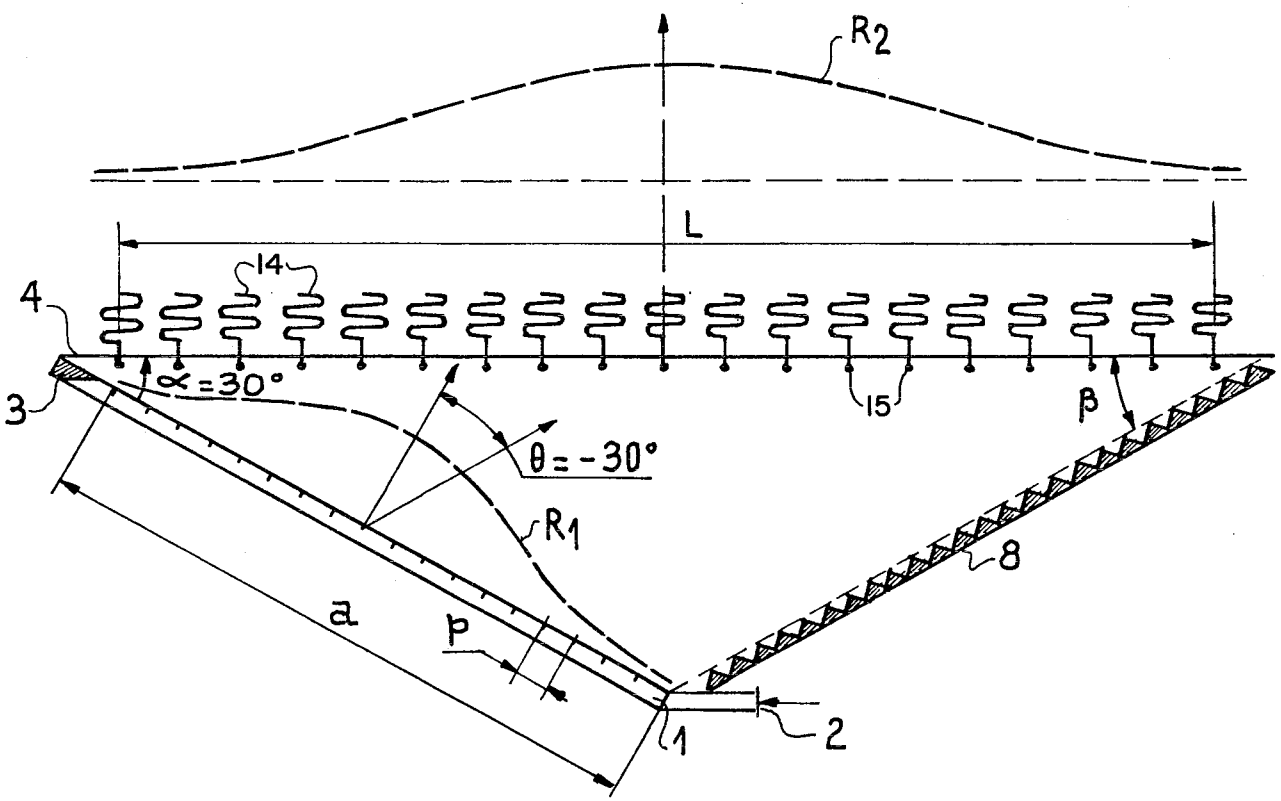

FIG. 2 is a graph which provides a mathematical approach to demonstrate that standing phase lines exist in the radiating near-field region of a primary array such as radiator assembly 1.

In this Figure, points on the dispersive linear array are plotted along an axis x. This dispersive array is assumed to radiate into a planar space xz where axis z is a line normal to the array. We further assume that the array radiates, at a frequency $f_0$, a planar wave in the direction of a vector $\vec{u}$ whose position is identified by its angle $\theta_0$ included with the normal line z.

The dispersivity of this array, that is to say the ability which it has to radiate in a direction other than that identified by the angle $\theta_0$, is a function of the wave number $K=2\pi/\lambda$.

In the case of a point M(x,z) in the planar space xz here considered, the planar wave radiated to that point is characterized, for a given polarization, by the scalar function $$\Psi(M)=e^{i\phi(K,x,z)} \text{ with } \phi(K,x,z)=K(\overrightarrow{OM},\vec{u})=K(x\cdot\sin\theta+z\cdot\cos\theta). \quad (1)$$

It will be shown that straight lines D, of gradient $\tan\alpha$, exist in the plane of radiation xz in which the phase is steady with respect to K, that is, with respect to frequency. An array located on such a straight line will be fed with a constant phase. The array will thus be nondispersive if it radiates perpendicularly to its plane.

The equation for such a straight line D is: $z=x\cdot\tan\alpha$

Equation (1) assumes the form:

$$\phi(K,x,z\cdot\tan\alpha)=K\frac{\sin(\Theta+\alpha)}{\cos\alpha} \quad (2)$$

The fact that the phase is steady along this straight line is expressed by the partial differential of equation (2) with respect to the wave number K, the result of which is expressed as:

$$\frac{\delta\phi}{\delta K}=\frac{\delta}{\delta K}K\frac{\sin(\Theta+\alpha)}{\cos\alpha}=0$$

If it is assumed that the index 0 characterizes the reference frequency, the resulting straight line D is defined by an angle $\alpha$ such that $$\tan(\Theta_o+\alpha)=-K_o\frac{\delta\Theta}{\delta K_o} \quad (3)$$

This condition can be stated precisely in the case of a primary array formed by a slotted waveguide fed with a traveling wave. If $\Phi(x)$ is the phase characteristic along the array of length a, the phase difference between its ends is related to the possible directions of radiation by an equation of the form:

$$\Phi(a)-\phi(0)=K_g a+n\pi=K\cdot a\cdot\sin\theta \quad (4)$$

where n is a whole number and $K_g$ is the number of the guided wave, i.e. $K_g=2\pi/\lambda_g$.

If equation (4) is differentiated, the dispersivity of the array can be defined as follows:

$$dK_g=K\cdot\cos\theta\cdot d\theta+\sin\theta\cdot dK \quad (5)$$

It is known that the guided wave is characterized by the expression $K_g^2+K_c^2=K^2$, in which $K_c$ is the cutoff wave number given by $K_c=2\pi/\lambda_c$.

As a result: $K_g dK_g=KdK$.

This latter expression is inserted in equation (5), which becomes:

$$K\frac{\delta\Theta}{\delta K}=\frac{\frac{K}{K_q}-\sin\Theta}{\cos\Theta} \quad (6)$$

This expression may be compared with expression (3) which was obtained for the general case, yielding:

$$\tan(\Theta_o+\alpha)=-\frac{\frac{K}{K_q}-\sin\Theta}{\cos\Theta_o}$$

which gives values for angle $\alpha$ as a function of the direction of radiation $\theta_0$ from the primary array at a frequency $f_0$.

If, for convenience, the angle $\beta$ included by the straight line D with the direction of radiation from the primary array is introduced, i.e.

$$\beta=\frac{\pi}{2}-(\Theta_o+\alpha), \quad (7)$$

this gives $$\frac{\sin\beta}{\sin\alpha}=\frac{K_q}{K}=\frac{\lambda}{\lambda_g} \quad (8)$$

From a knowledge of the angle $\theta_0$ of the radiation from the primary array relative to a normal to that array it is possible, by using formulae (7) and (8), to determine the angles $\alpha$ and $\beta$, and also to determine the number of slots in the guide forming the primary array and to define the complete structure of the array antenna according to our invention.

To give a numerical example, the angle $\theta_0$ may be equal to 30°. Since the wave numbers $K_g$ and K are substantially the same when $K_c > K_g$, the above-mentioned equations (7) and (8) give $\beta \approx \alpha = 30°$. More generally, equation (7) yields $\alpha \approx \beta \approx (\pi/4) - (\theta_0/2)$. If the slots in the guide are positioned on its small side with alternating inclinations, the pitch p of the slots is such that:

$$\frac{2\pi p}{\lambda_g} - \pi = \frac{2\pi p}{\lambda} \sin\Theta_0.$$

In the example selected:

$$\frac{p}{\lambda} = \frac{1}{1 + \frac{2\lambda}{\lambda_g}} \approx \frac{1}{3}$$

Assuming that the length L of the secondary array is of the order of 40 λ, the length of the primary array will be:

$$a = \frac{L \sin\beta}{\sin(\alpha + \beta)} \approx \frac{L}{\sqrt{3}}$$

The number of slots in the primary array will thus be:

$$N = a/p = 40\sqrt{3} \approx 69$$

In FIG. 2 we have shown successive wavefronts $P_1$, $P_2$, $P_3$ and $P_4$ for the selected frequency $f_0$. The distance between these wavefronts is equal to the corresponding wavelength $\lambda_0$. It may be mentioned that if the frequency of the traveling wave which feeds the slotted guide positioned on axis x changes, the angle $\theta$ being thus incremented by $d\theta$, the successive wavefronts $P'_1$, $P'_2$, $P'_3$ and $P'_4$ for the new selected frequency turn about points on the constant-phase line D. The wave which is then propagated between the primary and secondary arrays has a modified angle of incidence on the secondary array. A suitable adjustment of the phase shift at the array enables the radiation from the secondary array to retain its nondispersivity.

FIG. 3 shows an array antenna which conforms to the results given above. Present is the primary array 1, which is formed by a slotted guide with p representing the pitch of the slots which are formed over a length a. The primary array is fed with a traveling wave at end 2, the other end being again closed by an absorbent load 3. The secondary array 4 is formed by a number of helices 14 whose inputs are dipoles 15 facing the slotted guide 1. The use of helices as outwardly radiating elements makes it possible to dispense with a fixed phase-shifting stage, the requisite phase shift being obtainable by adjusting the orientation of the helices. Angle $\alpha$ is of the order of 30°, as is also the angle $\theta$ which indicates the direction of radiation of the wave emitted from guide 1.

The third side of the triangle having its other two sides defined by the arrays 1 and 4 is formed by an absorbent panel 8. This panel prevents waves from spilling outside the system and ensures that the assembly is more rigid mechanically. Such an embodiment has the advantage in the case of an electronically scanning antenna that the panel 8 absorbs reflected radiation, which is related to the active reflection coefficient of the arrays, as defined for example in the book "Microwave Scanning Antennas" by R. C. Hansen, Vol. II, Academic Press, New York and London, 1966, page 306. Also shown in FIG. 3 are the quasi-Gaussian illumination patterns $R_1$ and $R_2$ of the primary and secondary arrays, respectively.

In the foregoing discussion we have shown that it is possible to produce a nondispersive prism-array antenna according to the invention and that a secondary array positioned on the straight line D defined above does in fact generate a planar wave with the phase of the electrical field steady, this secondary array being sited in the so-called radiating near-field region of the primary array. It may be mentioned that it is therefore desirable that the illumination by the primary array be Gaussian or Gaussian-derived. The field radiated by the primary and secondary arrays remains Gaussian in principle, thus assisting, inter alia, in achieving low sidelobe levels.

It should be mentioned that the Gaussian illumination pattern is an ideal pattern but can be sufficiently closely approached for the antenna according to our invention to be nondispersive to a good second-order approximation. A calculation can be made which supports this assertion.

Figure 4:
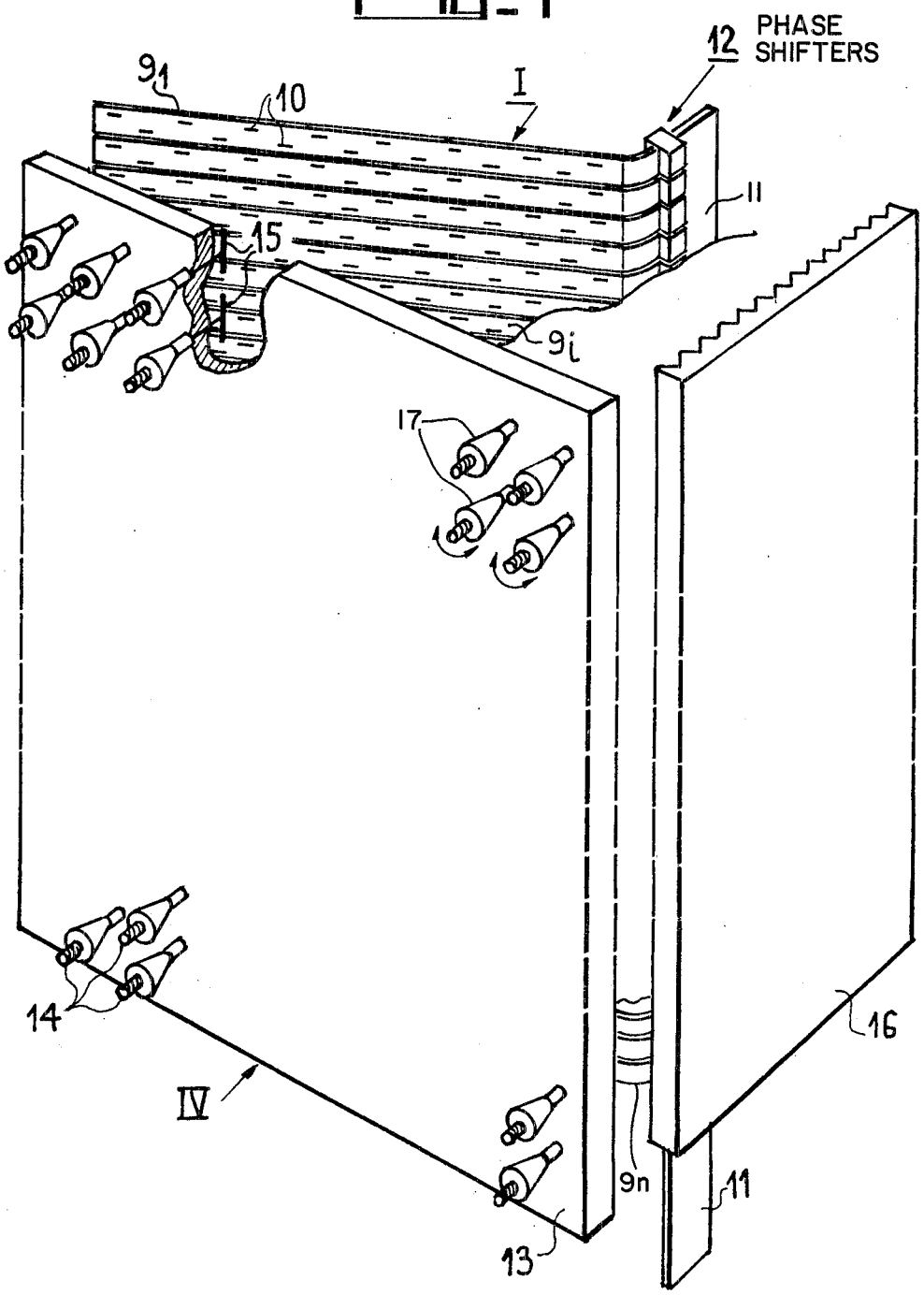
FIG. 4 is a diagrammatic view of a further embodiment with two-dimensional radiator arrays.

FIG. 4 is a view of a two-dimensional-array antenna conforming to our invention.

The primary array I is formed by a number of slotted guides $9_1 \ldots 9_i \ldots 9_n$, each containing the same number of slots 10. All the guides are fed in parallel at one of their ends by a channel 11. Phase shifters 12, of the electronic kind for example, are provided in cases where it is desired to use the antenna to perform an electronic scan in a vertical plane perpendicular to the plane of the Figure as well as to the plane of radiation xz shown in FIG. 2.

The secondary array IV is similar to array 4 of FIG. 3 and is formed by a panel 13 carrying a number of radiating elements 14 which are rotatable helices provided with mountings 17 and fed by dipoles 15. The third face of the trihedron so formed is an absorbent panel 16 whose function is the same as that mentioned in the case of the absorbent panel 8 of FIG. 3.

It should be pointed out that in this embodiment there are no fixed phase shifters such as the elements 7 visible in FIG. 1. They are not required since the rotatable helices 14 allow the phase to be adjusted by turning the helix on its axis.

There has thus been described a nondispersive array antenna of small bulk, and its expansion into an electronically scanning antenna structure. In the latter case the fixed phase shifters of the second array are replaced by controllable variable phase shifters. The electronically scanning antenna structure so produced has the advantage of being aperiodic to the first order and of not suffering from masking effects or spillover.

We claim:

1. A nondispersive array antenna comprising:

a primary radiator array in the form of at least one slotted waveguide with an input end connected to a source of high-frequency waves to be sent out through the slots thereof in a plane of radiation at a frequency-dependent angle to a line perpendicular to said waveguide; and a secondary radiator array including an acute angle with said waveguide in said plane of radiation, said secondary array being formed from a multiplicity of elemental radiation receivers and a like multiplicity of elemental radiation emitters disposed in at least one pair of parallel rows back-to-back, said radiation receivers facing said waveguide and being linked with respective radiation emitters proximal thereto by coupling means introducing predetermined phase shifts between incoming and outgoing radiation which compensate for the phase displacement undergone along said arrays by the waves passing in said plane of radiation from said waveguide to said radiation receivers whereby said secondary array generate an outgoing beam with a wavefront paralleling the row of radiation emitters.

2. An array antenna as defined in claim 1 wherein said frequency-dependent angle has a predetermined value $\theta_o$ for a frequency $f_o$ of said waves remote from the cutoff frequency of said waveguide, said acute angle having a value $\alpha \approx (\pi/4) - (\theta_o/2)$.

3. An array antenna as defined in claim 2 wherein $\alpha \approx 30°$.

4. An array antenna as defined in claim 1, 2 or 3 wherein said radiation emitters are helices with axes perpendicular to said secondary array, said coupling means comprising mountings enabling a rotation of said helices about their axes.

5. An array antenna as defined in claim 1, 2 or 3 wherein said primary array is a first panel perpendicular to said plane of radiation formed from a multiplicity of superposed slotted waveguides connected in parallel to said source, said secondary array being a second panel perpendicular to said plane of radiation formed from a multiplicity of superposed rows of elemental radiation receivers and emitters.

6. An array antenna as defined in claim 5, further comprising phase-shifting means inserted between said source and said waveguides for displacing said outgoing beam in a direction perpendicular to said plane of radiation.

7. An array antenna as defined in claim 1, 2 or 3 wherein said arrays closely approach each other at the end of said waveguide opposite said input end.

8. An array antenna as defined in claim 7 wherein said arrays form two sides of a triangle whose third side is formed by a panel absorbing reflected radiation.

9. A nondispersive array antenna comprising:

a primary radiator array formed from at least one pair of elemental radiators connected to a source of high-frequency waves to be sent out in a plane of radiation; and a secondary radiator array including an acute angle with said primary array in said plane of radiation, said secondary array being formed from a multiplicity of dipoles and a like multiplicity of helical radiators disposed in at least one pair of parallel rows with said dipoles facing said primary array and being linked with respective helical radiators proximal thereto, said helical radiators having mutually parallel axes and occupying relative angular positions introducing predetermined phase shifts between incoming and outgoing radiation which compensate for the phase displacement undergone along said arrays by the waves passing in said plane of radiation from said primary array to said secondary array whereby the latter generates an outgoing beam with a wavefront paralleling the row of helical radiators.

10. An array antenna as defined in claim 9 wherein said primary array is a first perpendicular to said plane of radiation formed from a multiplicity of superposed rows of elemental radiators, said secondary array being a second panel perpendicular to said plane of radiation formed from a multiplicity of superposed rows of dipoles and helical radiators.

11. An array antenna as defined in claim 10 wherein said rows of elemental radiators are connected in parallel to said source via phase-shifting means for displacing said outgoing beam in a plane perpendicular to said plane of radiation.

12. An array antenna as defined in claim 10 or 11, further comprising a radiation-absorbing third panel complementing said first and second panels to a trihedron.

* * * * *